US006299537B1

(12) United States Patent
Clowser

(10) Patent No.: US 6,299,537 B1
(45) Date of Patent: Oct. 9, 2001

(54) LASER POINTING NUNCHAKU ASSEMBLY

(76) Inventor: Jim J. Clowser, 6503 NW. 34th, Bethany, OK (US) 73008

( * ) Notice: Subject to any disclaimer, the term of this patent is extended or adjusted under 35 U.S.C. 154(b) by 0 days.

(21) Appl. No.: 09/616,916

(22) Filed: Jul. 14, 2000

(51) Int. Cl.[7] ..... A63B 15/00
(52) U.S. Cl. ..... 463/47.5; 463/47.4; 362/102
(58) Field of Search ..... 463/47.4, 47.5; 362/102, 109, 234, 253

(56) References Cited

U.S. PATENT DOCUMENTS

D. 382,608 8/1997 Hayes .
791,379 5/1905 Somes .
3,454,274 7/1969 Kaneshiro .
4,168,588 9/1979 Snyder .
4,586,715 5/1986 Scolari et al. .
5,547,190 8/1996 Mackewich, Jr. et al. .
5,725,440 * 3/1998 Finney .
5,818,036 * 10/1998 Daly .
5,844,377 * 12/1998 Anderson et al. .
6,024,467 * 2/2000 Liu .
6,126,292 * 10/2000 Liu .

* cited by examiner

*Primary Examiner*—William M. Pierce

(57) ABSTRACT

A laser pointing nunchaku assembly for providing a visual display of light when using the invention. The laser pointing nunchaku assembly includes a first and second elongated handle portions that each have a first and second end portion. A substantially non-elastic cord has opposite ends. Each of the opposite ends is coupled to an associated first end of the first and second elongated handle portions. Each second end portion of the first and second elongated handle portions includes an opening extending into the second end portion.

The invention further comprises a pair of laser pointer assemblies. Each laser pointer assembly is insertable into the opening of an associated one of the second end portions of the first and second elongated handle portions. Each of the pair of laser pointer assemblies is selectively engageable to the associated second end portion such that the laser pointer assembly directs a coherent beam of light outwardly from the associated second end portion.

12 Claims, 2 Drawing Sheets

LASER POINTING NUNCHAKU ASSEMBLY

BACKGROUND OF THE INVENTION

1. Field of the Invention

The present invention relates to weapons and more particularly pertains to a new laser pointing nunchaku assembly for providing a visual display of light when using the invention.

2. Description of the Prior Art

The use of weapons is known in the prior art. More specifically, weapons heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,547,190; 4,586,715; Des. 382,608; U.S. Pat. Nos. 3,454,274; 791,376; and 4,168,588.

While these devices fulfill their respective, particular objectives and requirements, the aforementioned patents do not disclose a new laser pointing nunchaku assembly. The inventive device includes first and second elongated handle portions that each have a first and second end portion. A substantially non-elastic cord has opposite ends. Each of the opposite ends is coupled to an associated first end of the first and second elongated handle portions. Each second end portion of the first and second elongated handle portions includes an opening extending into the second end portion.

The invention further comprises a pair of laser pointer assemblies. Each laser pointer assembly is insertable into the opening of an associated one of the second end portions of the first and second elongated handle portions. Each of the pair of laser pointer assemblies is selectively engageable to the associated second end portion such that the laser pointer assembly directs a coherent beam of light outwardly from the associated second end portion.

In these respects, the laser pointing nunchaku assembly according to the present invention substantially departs from the conventional concepts and designs of the prior art, and in so doing provides an apparatus primarily developed for the purpose of providing a visual display of light when using the invention.

SUMMARY OF THE INVENTION

In view of the foregoing disadvantages inherent in the known types of weapons now present in the prior art, the present invention provides a new laser pointing nunchaku assembly construction wherein the same can be utilized for providing a visual display of light when using the invention.

The general purpose of the present invention, which will be described subsequently in greater detail, is to provide a new laser pointing nunchaku assembly apparatus and method which has many of the advantages of the weapons mentioned heretofore and many novel features that result in a new laser pointing nunchaku assembly which is not anticipated, rendered obvious, suggested, or even implied by any of the prior art weapons, either alone or in any combination thereof.

To attain this, the present invention generally comprises first and second elongated handle portions that each have a first and second end portion. A substantially non-elastic cord has opposite ends. Each of the opposite ends is coupled to an associated first end of the first and second elongated handle portions. Each second end portion of the first and second elongated handle portions includes an opening extending into the second end portion. The invention further comprises a pair of laser pointer assemblies. Each laser pointer assembly is insertable into the opening of an associated one of the second end portions of the first and second elongated handle portions. Each of the pair of laser pointer assemblies is selectively engageable to the associated second end portion such that the laser pointer assembly directs a coherent beam of light outwardly from the associated second end portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new laser pointing nunchaku assembly and method which has many of the advantages of the weapons mentioned heretofore and many novel features that result in a new laser pointing nunchaku assembly which is not anticipated, rendered obvious, suggested, or even implied by any of the prior art weapons, either alone or in any combination thereof.

It is another object of the present invention to provide a new laser pointing nunchaku assembly which may be easily and efficiently manufactured and marketed.

It is a further object of the present invention to provide a new laser pointing nunchaku assembly which is of a durable and reliable construction.

An even further object of the present invention is to provide a new laser pointing nunchaku assembly which is susceptible of a low cost of manufacture with regard to both materials and labor, and which accordingly is then susceptible of low prices of sale to the consuming public, thereby making such laser pointing nunchaku assembly economically available to the buying public.

Still yet another object of the present invention is to provide a new laser pointing nunchaku assembly which provides in the apparatuses and methods of the prior art some of the advantages thereof, while simultaneously overcoming some of the disadvantages normally associated therewith.

Still another object of the present invention is to provide a new laser pointing nunchaku assembly for providing a visual display of light when using the invention.

Yet another object of the present invention is to provide a new laser pointing nunchaku assembly which includes first and second elongated handle portions that each have a first and second end portion. The assembly includes a substantially non-elastic cord that has opposite ends. Each of the opposite ends is coupled to an associated first end of the first and second elongated handle portions. Each second end portion of the first and second elongated handle portions includes an opening extending into the second end portion. The invention further includes a pair of laser pointer assemblies. Each laser pointer assembly is insertable into the opening of an associated one of the second end portions of the first and second elongated handle portions. Each of the pair of laser pointer assemblies is selectively engageable to the associated second end portion such that the laser pointer assembly directs a coherent beam of light outwardly from the associated second end portion.

Still yet another object of the present invention is to provide a new laser pointing nunchaku assembly that allows a nunchaku user more creativity in weaponry competitions.

Even still another object of the present invention is to provide a new laser pointing nunchaku assembly that entails a new entertainment style when using the nunchaku weaponry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
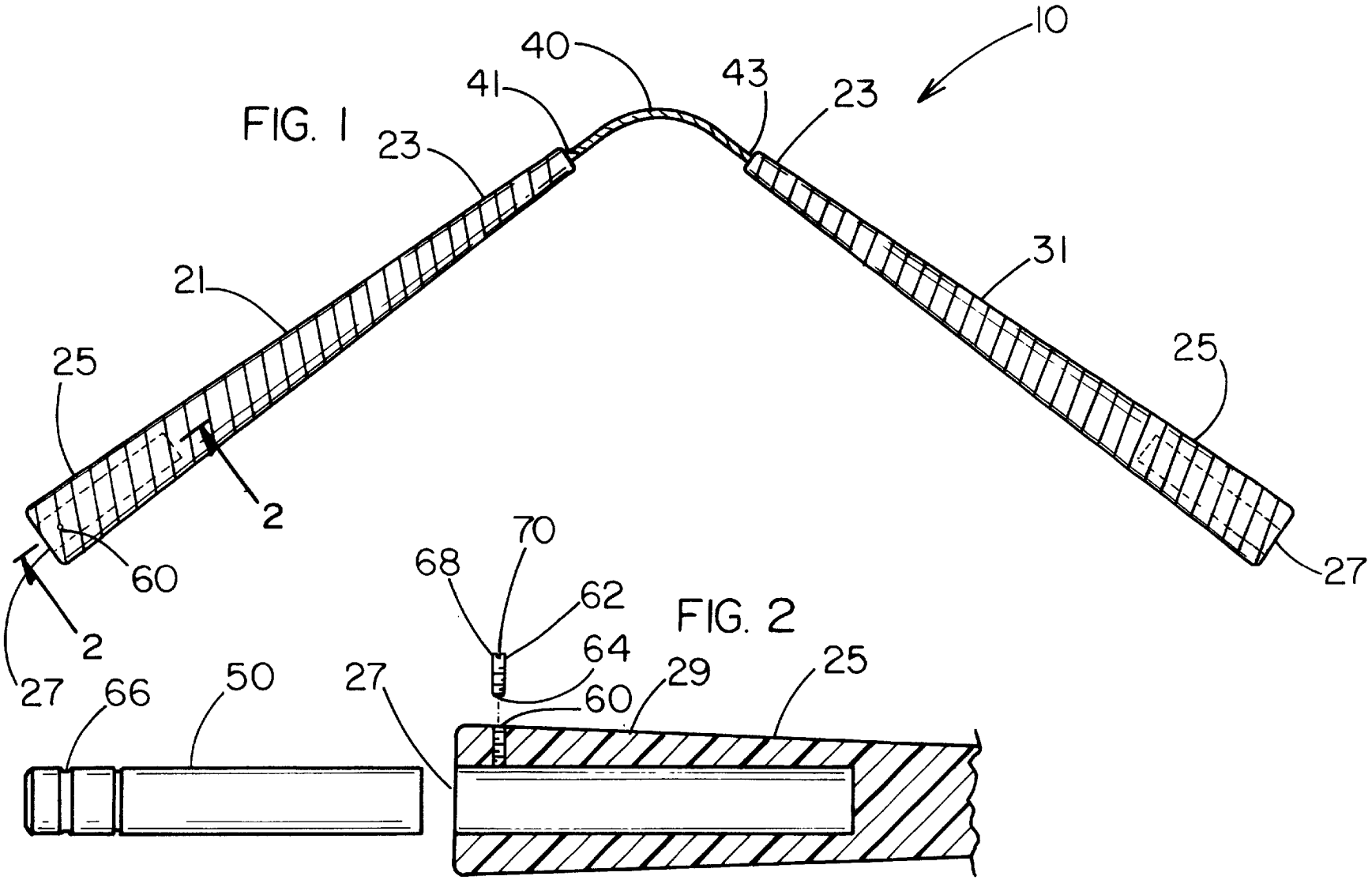
FIG. 1 is a schematic front view of a new laser pointing nunchaku assembly according to the present invention.
FIG. 2 is a schematic cross-sectional view of the present invention taken along line 2—2 of FIG. 1.
Figure 3:
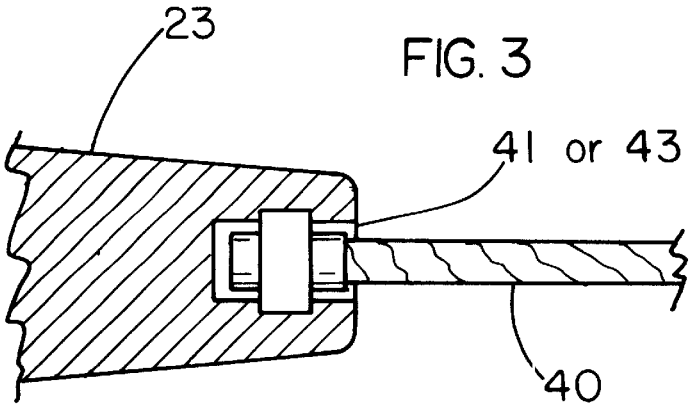
FIG. 3 is a schematic cross-sectional view of the present invention taken along line 3—3 of FIG. 1.
Figure 5:
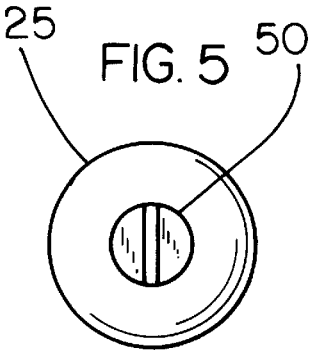
FIG. 5 is an end view along line 5—5 of FIG. 4 of the present invention.
Figure 4:
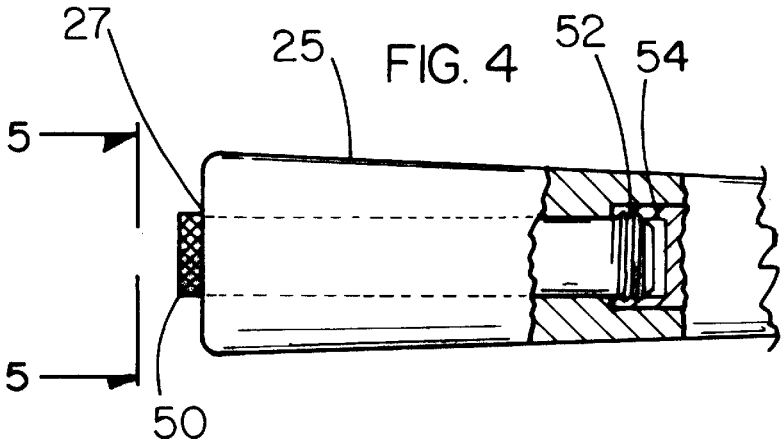
FIG. 4 is a partial cut away view of the present invention.

With reference now to the drawings, and in particular to FIGS. 1 through 5 thereof, a new laser pointing nunchaku assembly embodying the principles and concepts of the present invention and generally designated by the reference numeral 10 will be described.

As best illustrated in FIGS. 1 through 5, the laser pointing nunchaku assembly 10 generally comprises a first elongated handle portion 21 and a second elongated handle portion 31. Each handle portion 21 and 31 includes a first and second end portion 23 and 25. A substantially non-elastic cord 40 includes opposite ends 41 and 43. Each of the opposite ends 41 and 43 is coupled to an associated first end 23 of the first and second elongated handle portions 21 and 31. Each second end portion 25 of the first and second elongated handle portions 21 and 31 includes an opening 27 extending into the second end portion 25.

The invention further comprises a pair of laser pointer assemblies 50. Each laser pointer assembly 50 is insertable into the opening 27 of an associated one of the second end portion 25 of the first and second elongated handle portions 21 and 31. Each of the pair of laser pointer assemblies 50 is selectively engageable to the associated second end portion 25 such that the laser pointer assembly 50 directs a coherent beam of light outwardly from the associated second end portion 25.

In an embodiment, each laser pointer assembly 50 is generally cylindrical. Each opening 27 into the second ends of the first and second elongated handle portions 21 and 31 is also generally cylindrical for slidably receiving the associated laser pointer assembly 50 snugly therein to prevent lateral movement of the associated laser pointer assembly 50 within the opening 27 during use of the nunchaku assembly 10.

In an embodiment, each laser pointer assembly 50 includes an externally threaded proximal end portion 52. Each opening 27 in the associated second end 25 of the first and second elongated handle portions 21 and 31 includes an inwardly facing threaded portion 54 for engaging the proximal end 52 of the associated laser pointer assembly 50. Thus, the laser pointer is securable to the associated second end 25. Each laser pointer assembly 50 is positionable within a selectable one of the openings 27 in the second end 25 of the first and second elongated handle portions 21 and 31 such that a longitudinal axis of the laser pointer assembly 50 is coaxial with a longitudinal axis of the selected opening 27.

Each of the first and second handle portions 21 and 3 1 includes a threaded aperture 60 that extends between an exterior surface of the first and second elongated handle portions 21 and 31 and the associated opening 27. The invention further comprises a pair of laser locking members 62. Each laser locking member 62 is threaded complimentary to an associated one of the threaded apertures 60. Thus, the laser locking member 62 is insertable into the threaded aperture 60 such that a first end 64 of the laser locking member 62 extends into the opening 27 to abut the laser pointer assembly 50 positioned in the opening 27. Therefore, each laser pointer assembly 50 is securable to the associated second end 25 of said first and second elongated handle portions 21 and 31.

Each laser pointer assembly 50 has a circumferential groove 66. The circumferential groove 66 is alignable with the threaded aperture 60. Thus, when the laser pointer assembly 50 is inserted into the associated second end 25, the first end of the laser locking member 62 inserts into the circumferential groove 66 so as to secure the laser pointer assembly 50 in the opening 27 of the associated second end 25.

Each laser locking member 62 has a second end 68. This second end 68 has a depression 70 adapted for receiving a driving tool to rotate the laser locking member 62 within the threaded aperture 60. The second end 68 of said laser locking member 62 is positioned within the threaded aperture 60 such that the second end 68 is prevented from protruding from the exterior surface 29 of each of the first and second elongated handle portions 21 and 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nunchaku assembly, comprising:

a first and second elongated handle portions each having a first and second end portion;

a substantially non-elastic cord having opposite ends, each of said opposite ends being coupled to an associated first end of said first and second elongated handle portions;

each second end portion of said first and second elongated handle portions having an opening extending into said second end portion;

a pair of laser pointer assemblies, each laser pointer assembly being insertable into said opening of an associated one of said second end portions of said first and second elongated handle portions, each of said pair of laser pointer assemblies being selectively engageable to said associated second end portion such that said laser pointer assembly directs a coherent beam of light outwardly from said associated second end portion such that said coherent beam of light is visible extending away from said associated second end portion;

each laser pointer assembly being generally cylindrical;

each said opening into said second ends of said first and second elongated handle portions being generally cylindrical for slidably receiving said associated laser pointer assembly snugly therein to prevent lateral movement of said associated laser pointer assembly within said opening during use of said nunchaku assembly;

each of said first and second handle portions including a threaded aperture extending between an exterior surface of said first and second elongated handle portions and said associated opening; and a pair of laser locking members, each laser locking member being threaded complimentary to an associated one of said threaded apertures whereby said laser locking member is removably insertable into said threaded aperture such that a first end of said laser locking member is extendable into said opening to abut said laser pointer assembly positioned in said opening whereby each laser pointer assembly is removably securable to said associated second end of said first and second elongated handle portions.

2. The nunchaku assembly of claim 1, further comprising:

each laser pointer assembly having a circumferential groove, said circumferential groove being alignable with said threaded aperture when said laser pointer assembly is inserted into said associated second end such that said first end of said laser locking member is insertable into said circumferential groove for facilitating securement of said laser pointer assembly in said opening of said associated second end.

3. The nunchaku assembly of claim 1, further comprising:

each laser locking member having a second end, said second end having a depression adapted for receiving a driving tool for rotating said laser locking member within said threaded aperture.

4. The nunchaku assembly of claim 1, further comprising:

each laser locking member having a second end, said second end of said laser locking member being positionable within said threaded aperture such that said second end is prevented from protruding from said exterior surface of each of said first and second elongated handle portions.

5. The nunchaku assembly of claim 1, further comprising:

each laser pointer assembly having an externally threaded proximal end portion;

each opening in said associated second end of said first and second elongated handle portions having an inwardly facing threaded portion for engaging said proximal end of said associated laser pointer assembly whereby said laser pointer is securable to said associated second end.

6. The nunchaku assembly of claim 1, further comprising:

each said laser pointer assembly being positionable within a selectable one of said openings in said second end of said first and second elongated handle portions such that a longitudinal axis of said laser pointer assembly is coaxial with a longitudinal axis of said selected opening.

7. The nunchaku assembly of claim 1, further comprising:

each laser pointer assembly having a distal end, each said laser pointer assembly being engageable to said associated second end such that said distal end protrudes from said associated second end, said distal end being rotatable to selectively actuate said laser pointer.

8. The nunchaku assembly of claim 1, further comprising:

each laser pointer assembly having a centrifugal actuation switch such that centrifugal force during use of said nunchaku assembly actuates said laser pointing assemblies.

9. A nunchaku assembly, comprising:

a first and second elongated handle portions each having a first and second end portion;

a substantially non-elastic cord having opposite ends, each of said opposite ends being coupled to an associated first end of said first and second elongated handle portions;

each second end portion of said first and second elongated handle portions having an opening extending into said second end portion;

a pair of laser pointer assemblies, each laser pointer assembly being insertable into said opening of an associated one of said second end portions of said first and second elongated handle portions, each of said pair of laser pointer assemblies being selectively engageable to said associated second end portion such that said laser pointer assembly directs a coherent beam of light outwardly from said associated second end portion such that said coherent beam of light is visible extending away from said associated second end portion;

each laser pointer assembly being generally cylindrical;

each said opening into said second ends of said first and second elongated handle portions being generally cylindrical for slidably receiving said associated laser pointer assembly snugly therein to prevent lateral movement of said associated laser pointer assembly within said opening during use of said nunchaku assembly;

each of said first and second handle portions including a threaded aperture extending between an exterior surface of said first and second elongated handle portions and said associated opening;

a pair of laser locking members, each laser locking member being threaded complimentary to an associated one of said threaded apertures whereby said laser locking member is removably insertable into said threaded aperture such that a first end of said laser locking member is extendable into said opening to abut said laser pointer assembly positioned in said opening whereby each laser pointer assembly is removably securable to said associated second end of said first and second elongated handle portions;

each laser pointer assembly having a circumferential groove, said circumferential groove being alignable with said threaded aperture when said laser pointer assembly is inserted into said associated second end such that said first end of said laser locking member is insertable into said circumferential groove for facilitating securement of said laser pointer assembly in said opening of said associated second end;

each laser locking member having a second end, said second end having a depression adapted for receiving a driving tool for rotating said laser locking member within said threaded aperture;

each laser locking member having a second end, said second end of said laser locking member being positionable within said threaded aperture such that said second end is prevented from protruding from said exterior surface of each of said first and second elongated handle portions; and each said laser pointer assembly being positionable within a selectable one of said openings in said second end of said first and second elongated handle portions such that a longitudinal axis of said laser pointer assembly is coaxial with a longitudinal axis of said selected opening.

10. The nunchaku assembly of claim 9, further comprising:

each laser pointer assembly having a distal end, each said laser pointer assembly being engageable to said associated second end such that said distal end protrudes from said associated second end, said distal end being rotatable to selectively actuate said laser pointer.

11. A nunchaku assembly, comprising:

a first and second elongated handle portions each having a first and second end portion;

a substantially non-elastic cord having opposite ends, each of said opposite ends being coupled to an associated first end of said first and second elongated handle portions;

each second end portion of said first and second elongated handle portions having an opening extending into said second end portion;

a pair of laser pointer assemblies, each laser pointer assembly being insertable into said opening of an associated one of said second end portions of said first and second elongated handle portions, each of said pair of laser pointer assemblies being selectively engageable to said associated second end portion such that said laser pointer assembly directs a coherent beam of light outwardly from said associated second end portion;

each laser pointer assembly being generally cylindrical;

each said opening into said second ends of said first and second elongated handle portions being generally cylindrical for slidably receiving said associated laser pointer assembly snugly therein to prevent lateral movement of said associated laser pointer assembly within said opening during use of said nunchaku assembly;

each laser pointer assembly having an externally threaded proximal end portion;

each opening in said associated second end of said first and second elongated handle portions having an inwardly facing threaded portion for engaging said proximal end of said associated laser pointer assembly whereby said laser pointer is securable to said associated second end; and each said laser pointer assembly being positionable within a selectable one of said openings in said second end of said first and second elongated handle portions such that a longitudinal axis of said laser pointer assembly is coaxial with a longitudinal axis of said selected opening.

12. The nunchaku assembly of claim 11, further comprising:

each laser pointer assembly having a distal end, each said laser pointer assembly being engageable to said associated second end such that said distal end protrudes from said associated second end, said distal end being rotatable to selectively actuate said laser pointer.

* * * * *